United States Patent [19]

Wehmeyer et al.

[11] Patent Number: 4,625,830

[45] Date of Patent: Dec. 2, 1986

[54] WORK PLATFORM CENTERING APPARATUS

[75] Inventors: Donald T. Wehmeyer, Roselle; Ronald W. Barnhart, Elmhurst; Craig Beymer, Darien, all of Ill.

[73] Assignee: Economy Engineering, Inc., Bensenville, Ill.

[21] Appl. No.: 696,081

[22] Filed: Jan. 29, 1985

[51] Int. Cl.[4] ..... E04G 1/22

[52] U.S. Cl. ..... 182/19; 182/2; 182/69

[58] Field of Search ..... 182/19, 18, 2, 63, 69; 212/256

[56] References Cited

U.S. PATENT DOCUMENTS

| | | | |
|---|---|---|---|
| 2,529,193 | 11/1950 | Rueter | 182/19 |
| 3,228,659 | 1/1966 | Horst | 182/18 |
| 3,461,989 | 8/1969 | Prescott | 182/19 |
| 3,961,681 | 6/1976 | Fisher | 182/63 |
| 4,328,872 | 5/1982 | Orthwein | 182/19 |

*Primary Examiner*—Reinaldo P. Machado

*Assistant Examiner*—Alvin Chin-Shue

*Attorney, Agent, or Firm*—Douglas B. White

[57] ABSTRACT

There is provided an over-translation sensing and centering apparatus for a scissors lift work platform comprising a linear cam arranged with electronic sensing means to detect an out-of-balance condition. For transmitting the relative angular position of the scissors members to linear movement of the cam, there is provided a control member pivotally mounted to the cam having bar links pivotally mounted to each extremity and connecting the control member to each scissors member. As each scissors member extends, the angle of the members with respect to the base of the vehicle causes the respective extremity of the control member to shift. As long as the scissors members move in equal opposing increments, the control member mounted on the linear cam rotates only, but if one member moves more than its counterpart, the control member is caused to shift and thereby move the linear cam. This movement is then sensed by microswitches and corrective action is initiated through responsive solenoids in the hydraulic lift circuit.

5 Claims, 5 Drawing Figures

42a
46
44
48
50
42
40
38

50
42
38
40

42a
48
46
44
50
42
38
40

WORK PLATFORM CENTERING APPARATUS

BACKGROUND OF THE INVENTION

1. Field of the Invention

The present invention relates generally to elevating work platforms and, more particularly, to safety devices for detecting translation of the elevated platform in scissor lift apparatus and for maintaining the apparatus within balance.

2. Description of the Prior Art

Prior devices for maintaining the balance of elevating work platforms have been known in the art dealing with articulated booms. An example of such prior device is shown in U.S. Pat. No. 4,081,055. This device senses the vertical position of the boom in reference to the horizon. In response to an out-of-balance condition it disables the hydraulic system to prevent further movement of the boom. This is accomplished by providing the boom with a chain and sprocket mechanism whereby the position of the chain indicates the position of the articulated boom. Further, there is provided a position-indicating marker on the chain and a corresponding sensing plunger whereby predetermined movement of the chain actuates the plunger to signify out-of-limit travel.

Heretofore, no such device has been proposed for an elevating platform raised by a scissors mechanism. In such a system the out-of-balance condition of the platform depends upon the relative position of both scissors members. Accordingly, there is generally provided in the present invention mechanical means for sensing the relative position of the extending scissors members and for mechanically determining the relative horizontal shift of the platform. On sensing this shift appropriate automatic adjustments are made to the hydraulic lift system to return the platform to a balanced position.

SUMMARY OF THE INVENTION

The over-translation sensing and centering apparatus of the present invention comprises a linear cam arranged with electronic sensing means to detect an out-of-limit condition. Further there is disclosed mechanical linkage for transmitting the relative angular positon of the scissors members to linear movement of the linear cam. This linkage consists of a control member, pivotally mounted to the cam, having bar links pivotally mounted to each extremity to connect the extremities of the control member to each scissors member. As each scissors member extends, the angle of each member with respect to the base of the vehicle causes its respective extremity of the control member to shift. As long as the scissors members move in equal opposing increments, the control member mounted on the linear cam rotates only, but if one member moves more than its counterpart, the control member is caused to shift horizontally and thereby move the linear cam. When this movement exceeds predetermined limits, the condition is sensed by microswitches and corrective action is initiated through responsive solenoids in the hydraulic lift circuit.

Other objects and advantages of the invention will become apparent upon reading the following detailed description and upon reference to the drawings, in which.

While the invention will be described in connection with the preferred embodiment, it will be understood that we do not intend to limit the invention to that embodiment. On the contrary, we intend to cover all alternatives, modifications and equivalents as may be included within the spirit and scope of the invention as defined by the appended claims.

DESCRIPTION OF THE PREFERRED EMBODIMENT

Figure 1:
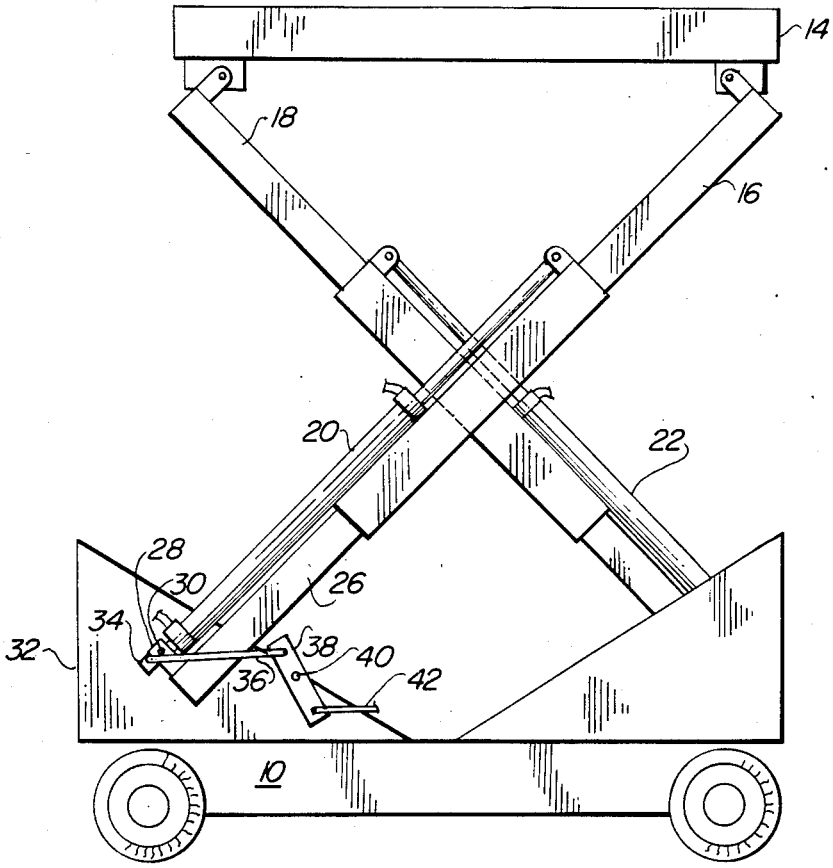
FIG. 1 is an elevational view of the elevating work platform.

Turning now to FIG. 1 there is shown a mobile work platform vehicle having a base 10 supported by driven wheels 12 and supporting an elevating platform. This apparatus is arranged to support and lift a platform 14 by extension of extensible scissors members 16 and 16*a*. These scissors members are extended by actuation of the hydraulic cylinders 20 and 20*a* and are mounted for pivotal motion to the work platform at their upper ends 24 and 24*a*. For simplicity, the detail and linkage between the scissors member and the linear cam will be described with respect to one side only since the linkage associated with the opposing scissors member is identical. At the lower end 26 of the scissors member there is provided a transversely protruding member 28 rigidly affixed to the telescoping scissors member and having located therein a pivotal connection 30 for supporting the scissors member in pivotal relation to the supporting structure 32. During extension or contraction of the scissors members when the platform is being raised and lowered, the scissors members will rotate about the pivotal connection. This rotation of the scissors members will be in direct relation to their respective extension.

The rotational motion of the scissors member is utilized to sense the position of the scissors members through connecting linkage. This linkage is connected to the transversely protruding member 28 of the scissors member at a bracket 34. A connecting rod 36 is arranged to connect the bracket member to one end of a first bar member 38 mounted to the support 32 for pivotal motion about its center 40. A second connecting rod 42 for the left scissors member is pivotally connected to the other end of the first bar member 38 and arranged to transmit the relative motion of the connecting rod 36 through the motion of the connecting rod 42 to the linear cam as more fully described below.

Figures 2, 3, 4:
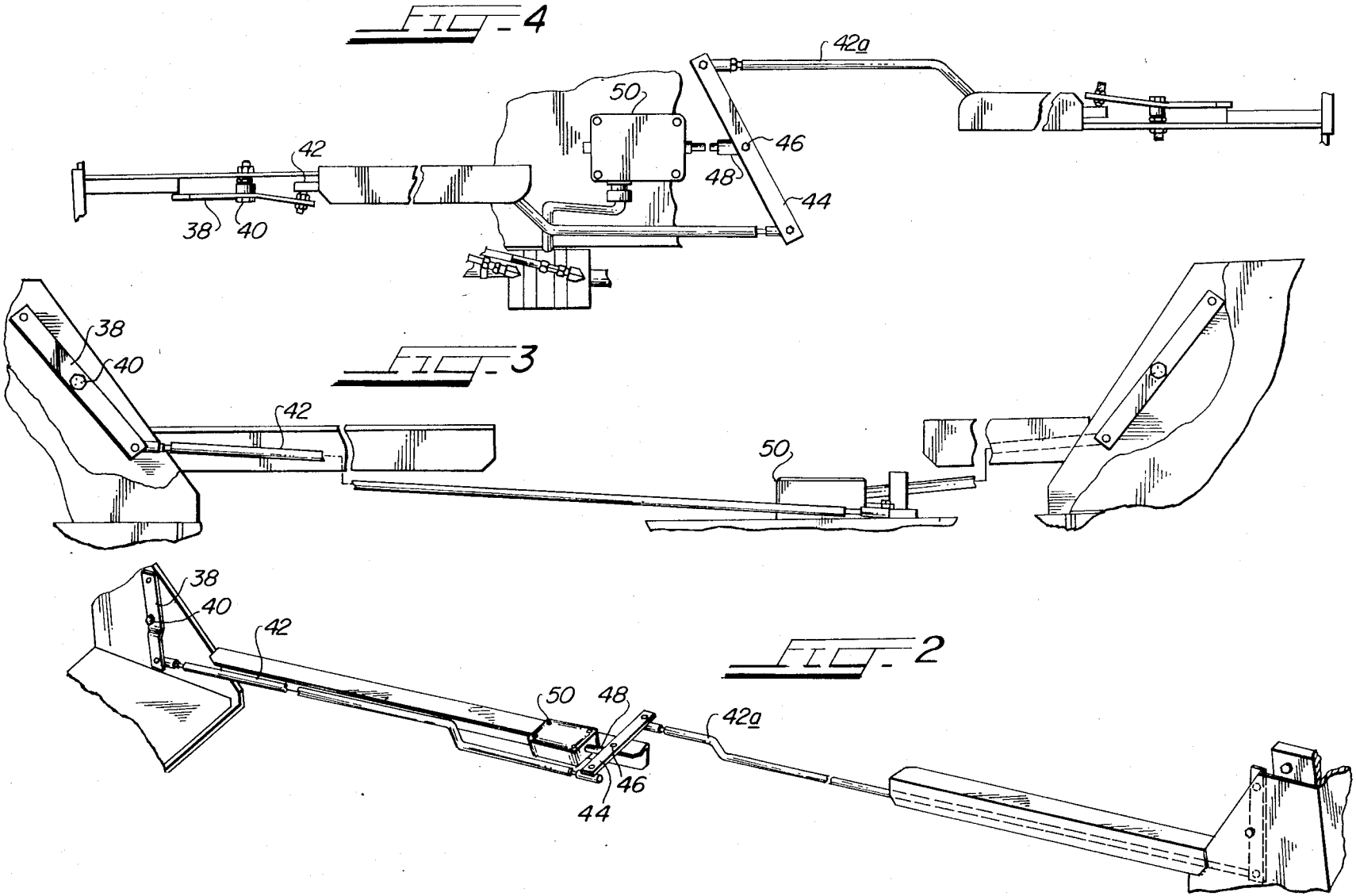
FIG. 2 is a pictorial view of the mechanical linkage of the present invention.
FIG. 3 is an elevational view of the mechanical linkage of the present invention.
FIG. 4 is a plan view of the mechanical linkage of the present invention.

Turning now to FIGS. 2, 3, and 4, there is shown in detail the first bar member 38 mounted on its pivot 40 for transmitting the motion of the scissors member to the connecting rod 42. There is further shown the connecting rod 42*a* of the right scissors member. The left and right rods, 42 and 42*a* respectively, are pivotally connected to opposing extremities of a second bar 44. This second bar 44 is mounted on a pivotal connection 46 at its center to control a linear cam 48 arranged to move laterally with the lateral movement of the elongated bar 44.

In operation, when the bars 42 and 42*a* move in equal but opposite directions, the bar 44 merely rotates about its pivot 46 and causes no lateral movement of the cam 48. When the bars 42 and 42*a* do not move in equal opposing increments, the elongated bar 44 will be caused to translate horizontally and to move the linear cam 48. The translation will be in direct relation to the difference in rotation of the scissors members and an indication of the position of the platform.

Figure 5:
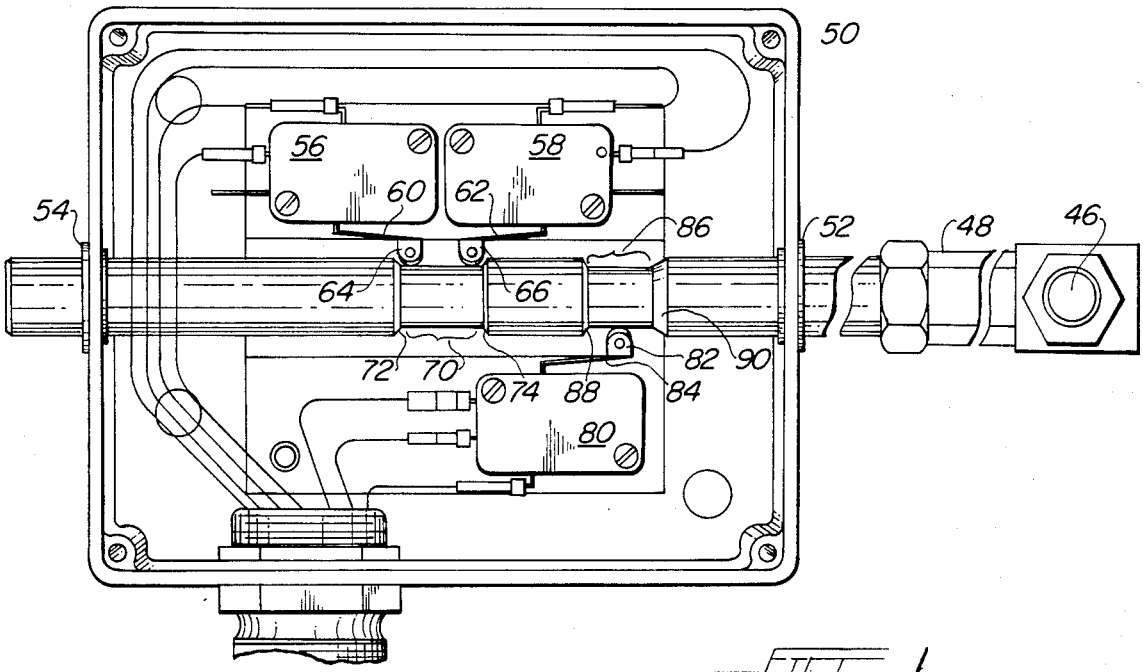
FIG. 5 is a plan view of the linear cam and the electronic sensors of the present invention.

To sense the linear motion of the linear cam 48, there is provided electronic sensing means, most clearly shown in FIG. 5. The linear cam is shown mounted for reciprocal motion within the enclosure 50 at openings 52 and 54 in the enclosure. For sensing the position of this linear cam there are provided electronic microswitches 56 and 58 having switch arms 60 and 62 respectively.

These microswitches are actuated by a defined section of the cam bar acting on the microswitch switch arm. On the extremity of each switch arm there are provided rollers 64 and 66 to ride upon the linear cam 48. The cam bar is provided with a defined section 70 within which the switch rollers ride during in-balance conditions. At the edges of this section there are provided edges 72 and 74 which the rollers strike when the linear cam is moved sufficiently in either direction to indicate an out-of-balance condition. Accordingly, movement of the linear cam towards the left in FIG. 5 will cause the roller 66 to strike the edge 74 and thereby actuate the microswitch 58. Movement of the linear cam 48 to the right in FIG. 5 causes the roller 64 of the microswitch 56 to strike the edge 72 and thereby actuate the switch.

In the preferred embodiment of the present invention, these switches electrically control solenoid valves to control flow to the hydraulic cylinders 20 and 22 in a manner well known in the art. As the platform is raised, if one scissors member extends further than the other scissors member, the platform will shift toward the side of the shorter member. This in turn results in a difference in angles between the telescoping scissors members and the supporting base. This angle of the telescoping scissors member relative to the support is transmitted through the linkage bars 36 and 42 to cause relative motion of the extremities of the control bar 44 pivotally mounted on the linear cam. Accordingly, as long as the telescoping scissors members are evenly matched in extension, the linkage bars 42 and 42*a* shift in equal but opposite direction, and no movement of the pivot point 46 occurs. But should either the left or right scissors member overextend or underextend, the relative position of the linkages 42 and 42*a* will be caused to shift to the left or to the right corresponding to the direction of overextension or underextension of the scissors member. This in turn moves the linear cam which actuates the appropriate microswitch. Upon sensing the overshift of the elevated platform, the microswitch is arranged to electronically open valves to direct hydraulic fluid under pressure into the appropriate hydraulic cylinder on the telescoping scissors member to bring the relative difference in the extension within tolerance limits. The electronically operated solenoid and hydraulic flow are not shown in the drawings as they are well known in the art.

Turning once again to FIG. 5 there is shown an additional microswitch 80 having a switch arm 82 with rollers 84 positioned on the extremity thereof. These rollers are arranged to ride upon a defined section 86 of a linear cam having edges 88 and 90 defined on either side thereof. This microswitch is arranged to disable the system and prevent further elevation or translation of the elevated platform in the event the out-of-balance condition exceeds acceptable limits. In the event the microswitches 56 or 58 have been actuated but have failed to bring the platform within balance and the linear cam moves further to either the left or the right indicating a further out-of-balance condition then, upon such further travel of the linear cam, the rollers 84 of the microswitch 80 will strike the edges 88 or 90. This indicates the ultimate tolerance limits of the out-of-balance condition and the microswitch 80 will be actuated. When this condition is sensed, the microswitch will operate a solenoid controlling the hydraulic lift circuits to shut off further flow to the elevating system.

We claim:

1. In an elevating work platform apparatus having a base and having a platform supported by first and second extensible scissors members mounted on the base by respective supporting pivots and means for extending each scissors member, the improvement comprising:

(a) a linear cam arranged for reciprocal linear travel;

(b) sensing means positioned along said linear cam to detect predetermined limits of linear travel; and (c) mechanical linkage connecting said linear cam to said first and second extensible scissors members for mechanically transposing the relative position of said scissors members to said linear travel of said linear cam, wherein said mechanical linkage comprises a control member pivotally mounted proximate its center to said linear cam and having pivotally mounted proximate its extremities first and second linking members connecting said control member to said first and second extensible scissors members respectively.

2. The apparatus of claim 1 wherein said mechanical linkage further comprises a first and second bar member pivotally attached to each respective scissors member in spaced relation to the respective supporting pivots of the scissors members, a first and second lever member pivotally attached to the base and having extending extremities, wherein said first and second respective linking members are pivotally affixed to one extremity of each respective lever member, and said first and second bar members are pivotally affixed to the opposite extremity of each respective lever member.

3. The apparatus of claim 2 further comprising lift control means arranged to respond to said sensing means and provide independent control of the means for extending each scissors member.

4. The apparatus of claim 3 wherein said sensing means comprises microswitch means positioned along said linear cam and arranged to be actuated by said linear cam upon the occurrence of predetermined limits of travel.

5. The apparatus of claim 3 further comprising lift shut-off means arranged to respond to said sensing means and provide lift terminating control of the means for extending each scissors member.

* * * * *